United States Patent [19]

Yajima

[11] 4,228,647

[45] Oct. 21, 1980

[54] CLICK MECHANISM OF A TIMEPIECE

[75] Inventor: Kenji Yajima, Tokyo, Japan

[73] Assignee: Kabushiki Kaisha Daini Seikosha, Tokyo, Japan

[21] Appl. No.: 909,641

[22] Filed: May 25, 1978

[30] Foreign Application Priority Data

Jun. 7, 1977 [JP] Japan ..... 52-73755[U]

[51] Int. Cl.[3] ..... G04B 27/00; G04B 37/08

[52] U.S. Cl. ..... 368/185; 368/289; 368/321

[58] Field of Search ..... 58/4 R, 4 A, 34, 58, 58/63, 73, 85.5, 88 B, 88 R, 90 R, 90 B, 99; 200/4, 6 R–6 RB

[56] References Cited

U.S. PATENT DOCUMENTS

| | | | |
|---|---|---|---|
| 3,151,441 | 10/1964 | Tsuzuki | 58/85.5 |
| 3,668,864 | 6/1972 | Miyasaka | 58/58 |
| 3,678,682 | 7/1972 | Miyasaka et al. | 58/58 |
| 3,707,840 | 1/1973 | Miyasaka | 58/58 |
| 3,978,296 | 8/1976 | Moriya et al. | 58/4 A X |
| 4,034,553 | 7/1977 | Wuthrich | 58/88 B |
| 4,126,992 | 11/1978 | Yasuda | 58/88 B |

FOREIGN PATENT DOCUMENTS

| | | | |
|---|---|---|---|
| 100993 | 9/1923 | Switzerland | 58/99 |

*Primary Examiner*—Vit W. Miska

*Attorney, Agent, or Firm*—Robert E. Burns; Emmanuel J. Lobato; Bruce L. Adams

[57] ABSTRACT

A click mechanism for a timepiece winding stem comprises a plurality of circumferential grooves axially spaced along the length of the winding stem, and a detent spring resiliently engageable within respective ones of the grooves to retain the winding stem in the desired axial operating position and enabling manual axial movement of the winding stem between different operating positions with a click action. The detent spring has an elongate portion which extends in side-by-side relationship along the length of the winding stem, and a detent portion connected to the elongate portion for engagement with the winding stem grooves. The thickness of the detent spring is no greater than the thickness of the winding stem and by arranging the two in side-by-side relationship, a thinner timepiece can be formed than would be possible if the detent spring extended above or below the winding stem.

2 Claims, 2 Drawing Figures

CLICK MECHANISM OF A TIMEPIECE

BACKGROUND OF THE INVENTION

The present invention relates to a click mechanism of a timepiece and more particularly to a small sized and thinly formed click mechanism of a timepiece which is capable of determining the operating position of an external operating member of the timepiece and providing and audible click.

Conventionally, as for an external operating member such as a winding stem or the like, the pull-out position of the operating member was determined by the composition of a setting lever, a cluth lever and a setting lever spring combined at the periphery of the winding stem and at the same time, the pull-out position was ascertained by customers by provision of a clicking associated with the winding stem. Further, the winding stem was prevented from coming completely out of the timepiece by the above mentioned composition.

However, there were several disadvantages which having prevented such timepieces from being made in small size and thin. Namely, in the above mentioned composition, there are a relatively large number of parts. Moreover, several parts were composed combining planely on the winding stem and the fitting conditions of the parts and the winding stem were released by moving the parts in the thickness direction of the timepiece whereby it was impossible to make the timepiece in small size and thin. Furthermore, in an analogue watch, there were instances where another external operating member was used other than the ordinary winding stem, whereby miniaturization of the watch became even more difficult.

SUMMARY OF THE INVENTION

Therefore, it is an object of the present invention to provide a click mechanism of a timepiece which is capable of determining a plurality of positions to pull out the winding stem for operating the time correction and calendar correction by a small sized and small number of parts and also to provide a click to the winding stem that eliminates the above mentioned conventional disadvantages.

DETAILED DESCRIPTION OF THE PREFERRED EMBODIMENT

Figure 1:
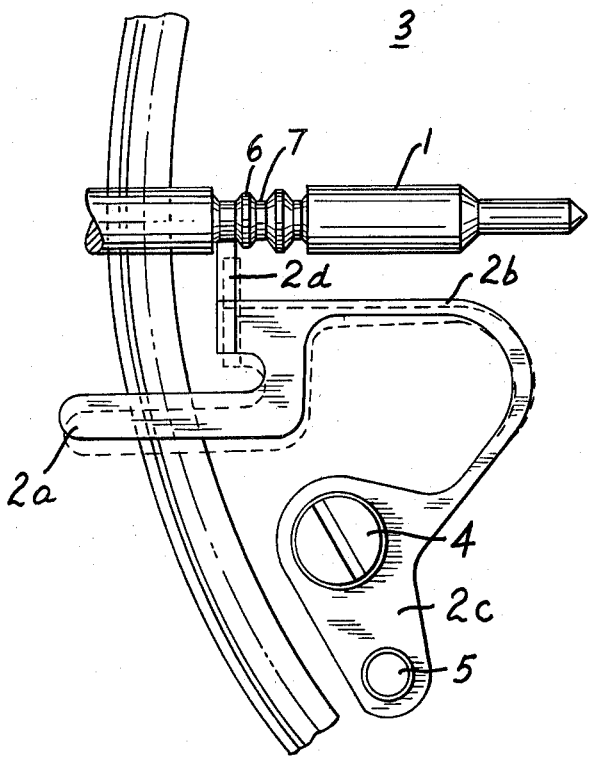
FIG. 1 is a plan view showing a detent spring incorporated into a plate of a timepiece to engage with an external operating member.

According to the drawing, numeral 1 is an external operating member such as a winding stem having a plurality of circumferential and axially spaced apart grooves 7 in order to determine at least two axial operating positions. Numeral 2 is a detent spring having at one end a fixed portion 2c which is fixed to a plate 3 and having at the other end or elongate a spring within and engages portion 2b formed as one body, a detent portion 2d which fits within and engages with the grooves 7 of the operating member 1 and an operating portion 2a which forks the detent portion 2d and elongates outwardly from the plate to release the fitting of the grooves 7 and the detent portion 2d. As shown in the drawing, the elongate portion 2b of the detent spring 2 is positioned parallel to and extends lengthwise alongside the external operating member 1 such that the grooves 7 and the detent portion 2d fit with and engage each other.

Figure 2:
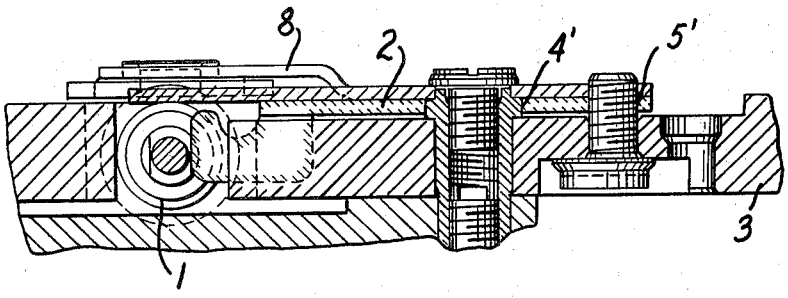
FIG. 2 is a side view of FIG. 1.

As shown in FIG. 1, the operating member 1 and the elongate portion 2b extend lengthwise in side-by-side relationship as viewed from the front (or rear) of the timepiece and as shown in FIG. 2, the thickness extent of the detent spring is no greater than that of the operating member as viewed from the side of the timepiece thereby enabling formation of a thin timepiece without any additional thickness being required to accommodate the detent spring.

Description will now be given of the operation of the click mechanism of the present invention. When the external operating member 1, which is normally pushed is toward the plate 3, is manually pulled out, the detent portion 2d of the detent spring 2 which normally fits within the groove 7 of the operating member 1 rides over at least one of the lands 6 provided between the grooves 7 of the operating member 1 with a click action and momentarily flexes the spring portion 2b and fits within another groove 7 and is thereby placed at one operating position. During this axial pull-out movement of the member 1, a click is produced at the operating member 1 and the customer or user hears the click.

When the operating member 1 is axially pulled out from the plate 3, the operating portion 2a slides parallel to and along the periphery of the plate 3. Therefore the spring portion 2b formed as one body is constrained to bend or flex in the slide direction and the detent portion 2d provided at the same end releases from the grooves 7, and without movement of the detent spring in the thickness direction of the timepiece, the operating member can be manually puffed out from the plate 3 and axially positioned at a selected operating position.

As understood from the above illustration, according to the present invention, a very simple and small sized, thinly made operating member can be obtained and positioning thereof and provision of a click are obtained by only one member.

I claim:

1. In a timepiece having a winding stem mounted for manual axial movement to a plurality of axial operating positions; a click mechanism for said winding stem comprising a plurality of circumferential grooves axially spaced apart along a section of the length of said winding stem; and a detent spring coacting with said winding stem to releasably retain said stem in a manually selected one of said operating positions and enabling manual axial movement of said stem between said operating positions with a click action, said detent spring having an elongate portion extending lengthwise alongside said winding stem in side-by-side relationship therewith as viewed from the front of the timepiece, a detent portion connected to said elongate portion and extending transversely thereof in the sideways direction towards said winding stem to resiliently engage within respective ones of said grooves in dependence upon the axial position of said winding stem to thereby releasably retain said stem in the manually selected operating position and being movable in the sideways direction to disengage from and slide along said grooves due to resilient flexing of said detent spring caused by manual axial movement of said winding stem to thereby enable axial movement of said stem with click action between said operating positions, and an operating portion connected to and extending parallel to said elongate portion and being constrained to move in a predetermined direction by sliding contact with a part of the timepiece thereby constraining said detent portion to move in said sideways direction during flexing of said detent spring caused by axial movement of said winding stem.

2. In a timepiece according to claim 2, wherein said detent spring has a thickness extent throughout no greater than that of said winding stem as viewed from the side of the timepiece with no part of said detent spring extending above or below the extent of said winding stem in the thickness direction of the timepiece.

* * * * *